US008132788B2

(12) United States Patent
Realegeno-Amaya

(10) Patent No.: US 8,132,788 B2
(45) Date of Patent: Mar. 13, 2012

(54) PARTITION LIFTER

(76) Inventor: Julio Realegeno-Amaya, Ottawa (CA)

( * ) Notice: Subject to any disclaimer, the term of this patent is extended or adjusted under 35 U.S.C. 154(b) by 396 days.

(21) Appl. No.: 12/424,073

(22) Filed: Apr. 15, 2009

(65) Prior Publication Data

US 2010/0264387 A1 Oct. 21, 2010

(51) Int. Cl.
*B66F 3/00* (2006.01)

(52) U.S. Cl. ..... 254/134; 254/133 R

(58) Field of Classification Search ..... 254/134, 254/133 R; 248/188.1, 188.2, 219.3
See application file for complete search history.

(56) References Cited

U.S. PATENT DOCUMENTS 2,786,650 A * 3/1957 Bottorff ..... 254/134
2,852,229 A * 9/1958 Gross ..... 254/134
4,068,826 A * 1/1978 Scott ..... 254/134
4,624,447 A * 11/1986 Richmeier ..... 254/93 H
5,261,643 A * 11/1993 Wurdack ..... 254/106
5,385,335 A * 1/1995 Wurdack ..... 254/1
5,628,610 A * 5/1997 Stratman et al. ..... 414/680
5,855,360 A * 1/1999 Wurdack ..... 254/100
5,915,670 A * 6/1999 Cain ..... 254/89 H
5,915,672 A * 6/1999 Dickey ..... 254/133 R
5,947,449 A * 9/1999 Dube et al. ..... 254/134
6,113,044 A * 9/2000 Stratman ..... 248/220.42
6,471,187 B1 * 10/2002 Dube et al. ..... 254/134
6,769,655 B2 * 8/2004 Beese ..... 248/188.91
D582,124 S * 12/2008 Wurdack ..... D34/35
2007/0114500 A1 * 5/2007 Hernandez ..... 254/1
2007/0200102 A1 * 8/2007 Hernandez ..... 254/1

* cited by examiner

*Primary Examiner* — David B Thomas
(74) *Attorney, Agent, or Firm* — Sunstein Kann Murphy & Timbers LLP

(57) ABSTRACT

A wall partition lifter has a vertically extending support beam, a sleeve that is freely slidable therearound and has a ledge extending transversely outwardly from one side. An engagement protuberance extends transversely outwardly from a second side. The engagement protuberance engages and vertically supports the wall partition and may comprise a series of hooks adapted to engage complementary slots in the wall partition, and/or a foot plate for supporting a bottom surface of the wall partition. The support beam has a base with a lip that extends beyond one side thereof. An extension actuator such as a jack may be positioned on the lip and engage the underside of the ledge such that when the jack is extended, the sleeve extends vertically, elevating the wall partition. A plurality of bores in the support beam provide a locking mechanism together with a cotter pin to prevent the sleeve from descending beyond a desired elevation, even when the jack is retracted and/or removed.

21 Claims, 2 Drawing Sheets

PARTITION LIFTER

FIELD OF THE INVENTION

The present invention relates to a lifting apparatus to elevate partitions, typically found in office settings, so as to permit access to the underlying carpet or flooring surface.

BACKGROUND

When installing carpet, hardwood floor or other type of floor covering, both the removal of existing floor covering (including preparation of the floor surface) and the installation of the new floor covering is facilitated by having easy access to the floor surface, and in particular, the floor surface near to walls.

Access to the floor surface may not be easily or quickly achieved, particularly in an office setting, because of the presence of furniture and other obstacles positioned across the floor surface.

It may not be convenient to empty the room of the furniture, since there may not be an alternate and convenient space in which the furniture to be removed may be stored. Furthermore, it may be difficult to move the furniture, especially if all of the furniture is being moved through doorways and openings and there is the possibility of damage to the room walls and doorways and to the furniture itself. Still further, the process of emptying a room of furniture may consume considerable resources, in terms of time, cost and human power.

In an office setting, the task is often further complicated by the division of a relatively large space into cubicles and offices through the use of a plurality of interconnected partitions or dividers across the floor surface. Clearing the space thus involves, prior to and in addition to the removal of the furniture, dismantling and removal of the wall partitions. Beside the difficulty discussed above in connection with the movement of furniture, which is also the case in connection with the movement of the wall partitions, additional complications arise. For example, the walls may be populated with shelves and personal knick-knacks to be removed, catalogued and stored prior to dismantling the walls.

More significantly, the layout of the wall structures into cubicles and offices is often complicated and may not be easily replicated after the floor covering has been installed without a clear and detailed map. Still further, because the walls are relatively interdependent, there may be a pre-determined order of disassembly and/or reassembly that will avoid unintentional collapse of the entire cubicle structure. In any event, additional human power may be called for in order to ensure avoiding such collapse.

An alternative that may be suitable in many cases of installation of floor coverings is to temporarily move the furniture a short distance away from its present location and elevate the wall partitions. In many instances, moving the furniture by approximately five feet away from a wall or corner and elevating a number of the wall partitions a few feet above the floor surface may provide sufficient access to allow the existing floor covering to be removed, the floor surface to be prepared and the new floor covering to be installed.

There are a number of partition lifting and moving devices disclosed in the prior art. Typically they have a partition engaging portion, such as a foot ledge that may engage the bottom of the partition, that may be urged upwards by an extension mechanism.

For example, U.S. Pat. No. 6,769,655 entitled "Workstation Panel Lifting Bracket" and issued Aug. 3, 2004 to Beese discloses a workstation panel lifting bracket adapted to be mounted to a jack to raise a workstation panel off the floor a sufficient distance to allow for access beneath the panel. The bracket comprises a generally horizontal top plate that is adapted to be mounted to the jack. A leg extends downwardly and forwardly from a forward edge of the top plate. Preferably, the leg forms an angle of about 80° to about 85° with the bracket top plate. A foot extends forwardly from a bottom end of the leg. An upwardly turned lip is preferably formed at the end of the foot. To provide stability to the bracket, jack, and panel during raising and lowering of the panel, the bracket also includes a brace on the leg. The brace has a front surface and opposed side surface. The side surfaces are generally triangular in shape, and the brace front surface is in a plane substantially perpendicular to a plane of said top plate. Preferably, the brace front face is approximately as long as the leg.

U.S. Pat. No. 5,915,670 entitled "Apparatus for Lifting Furniture in Place to Install Floor Covering Beneath It" issued Jun. 29, 1999 to Cain discloses an apparatus for lifting furniture in place to install floor covering underneath the furniture. The apparatus comprises a plurality of lifting assemblies. Each lifting assembly includes a substantially vertical piston and cylinder assembly. A piston rod is attached to each piston. The piston rod extends from the upper end of the piston and cylinder assembly and a substantially L-shaped member is attached to the piston rod. A pressurized fluid control system is constructed and arranged to uniformly supply pressurized fluid to the lifting assemblies; whereby, the lifting assemblies act together to simultaneously lift furniture in one movement when pressurized fluid is uniformly supplied from the pressurized fluid control system to the lifting assemblies.

U.S. Pat. No. 6,471,187 entitled "Apparatus for Lifting or Supporting Modular Furniture" issued Oct. 29, 2002 to Dubé et al. discloses an apparatus for lifting or supporting modular furniture panels having accessory hanging tracks with apertures, including a support having an upright shaft and a lifting jig movable on the shaft. The lifting jig has a support plate for engaging the underside of a panel, and an angle bracket above the support plate has a series of undercut hooks for engagement with apertures of a hanging track so as to positively locate the jig in relation to the panel. The angle bracket has an inner flange parallel to and attached to a front face of the lifting jig and an outer flange projecting perpendicularly from the front face and having the hooks. The inner flange is provided with horizontal slots which are engageable by screws which extend into said front face of the lifting jig and which allow lateral adjustment of the bracket relative to the lifting jig. The slots have enlarged end portions which allow the bracket to be removed from the lifting jig upon loosening of the screws, so that the bracket may be removed and repositioned in inverted position without removal of the screws; in inverted position the hooks can directly engage the hanging tracks.

A number of jack systems make use of a pin locking mechanism. U.S. Pat. No. 5,915,672 entitled "Collapsible Jack Stand and Method Therefor" issued Jun. 29, 1999 to Dickey discloses a highly portable collapsible jack stand. The jack stand is comprised of a plurality of leg members. Each leg member is detachably coupled to a top guide plate which is used to support and align a telescoping rod. A ram head is coupled to the telescoping rod and is used for supporting a load. A base plate is detachably coupled to the plurality of leg members. The base plate prevents the jack stand from sinking into the ground when the jack stand is in use and under a heavy load. A low profile jack may be positioned underneath the telescoping rod for raising and lowering the telescoping rod thus raising and lowering the load on the jack stand apparatus.

UK Patent Publication No. 2 190 962 entitled "Lifting Jacks" and published Dec. 2, 1987 to Sarra discloses a jack having an elongatable jack body comprising a pair of telescopically mutually slidable members forming a housing, a fluid pressure ram positioned within the housing such as to force elongation of the jack body in use, and a locking fork having arms positionable in holes in a first member to engage a second member to form a mechanical barrier against shortening of the jack body. The jack can be operated from the hydraulic fluid system of a tractor.

There remains a need for a simple lifting apparatus for elevating a wall partition which does not suffer from the limitations of the prior art.

SUMMARY OF THE INVENTION

According to one embodiment of the present invention there is provided a lifting apparatus for elevating a wall partition which extends substantially transversely from a surface. The apparatus comprises a support beam, a sleeve, an engagement protuberance and an extension actuator or jack. The support beam extends substantially transversely away from the surface. The sleeve is adapted to engage the support beam in a freely slidable fit and has a ledge extending transversely outwardly therefrom on a first side thereof. The engagement protuberance extends transversely outwardly from a second side of the sleeve and is adapted to engage, support and elevate a wall partition. The extension actuator or jack has an extension end. The jack is adapted for positioning substantially on the surface such that the extension end engages the ledge for extending the sleeve and the partition transversely away from the surface.

In another embodiment of the present invention, a lifting system is provided which comprises a plurality of lifting apparatuses as described above. The lifting apparatuses are adapted to be positioned at different wall partitions of a wall structure so as to elevate the wall structure beyond a surface.

In another embodiment of the present invention, there is provided a kit of parts for assembling a lifting apparatus for elevating a wall partition which extends substantially transversely from a surface. The kit of parts comprises an elongate support beam having a protruding base, a sleeve adapted to engage the support beam in a sliding fit and having a ledge extending transversely outwardly therefrom on a first side thereof, an engagement protuberance extending transversely outwardly from a second side of the sleeve and adapted to engage and support the wall partition, and an extension actuator having an extension end for engaging the base and the ledge for extending the sleeve and the partition transversely away from the base.

BRIEF DESCRIPTION OF THE DRAWINGS

The embodiments of the present invention will now be described by reference to the following figures, in which identical reference numerals in different figures indicate identical elements and in which:

FIG. 3(*b*) is a front elevation view of the engagement protuberance of FIG. 3(*a*);

DETAILED DESCRIPTION

A partition lifter is disclosed that has a vertical support beam surrounded by a sleeve in sliding engagement therewith. The sleeve is driven by a removable hydraulic jack in a vertical direction along the support beam. The sleeve may be locked in place relative to the support beam using a key and the jack removed thereafter. The sleeve has attached thereto one or more partition engagement protuberances to accept and urge vertically upwards a wall partition. A first partition engagement protuberance is a hooked section adapted to engage vertically arranged slots extending along the edges of the wall partition. A second partition engagement protuberance is a bottom ledge adapted to engage a bottom surface of the wall partition.

The present disclosure will now be described in detail for the purposes of illustration only, in conjunction with certain embodiments shown in the enclosed drawings.

Figure 1:
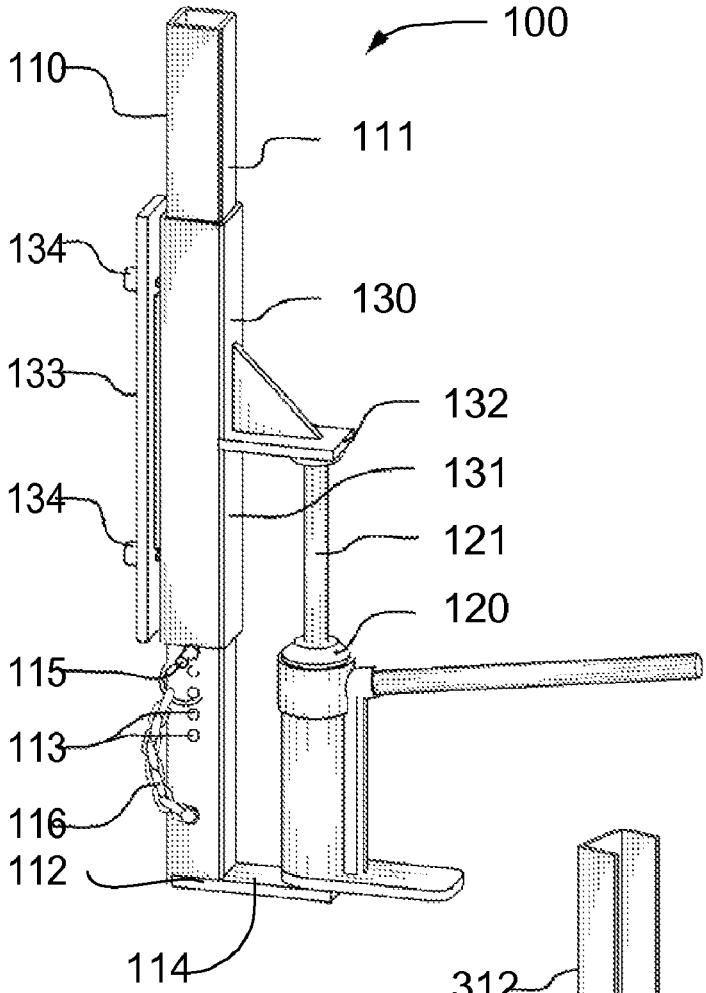
FIG. 1 is an elevation view of a partition lifter sub-assembly without engagement protuberance according to an embodiment of the present invention.
Figure 4:
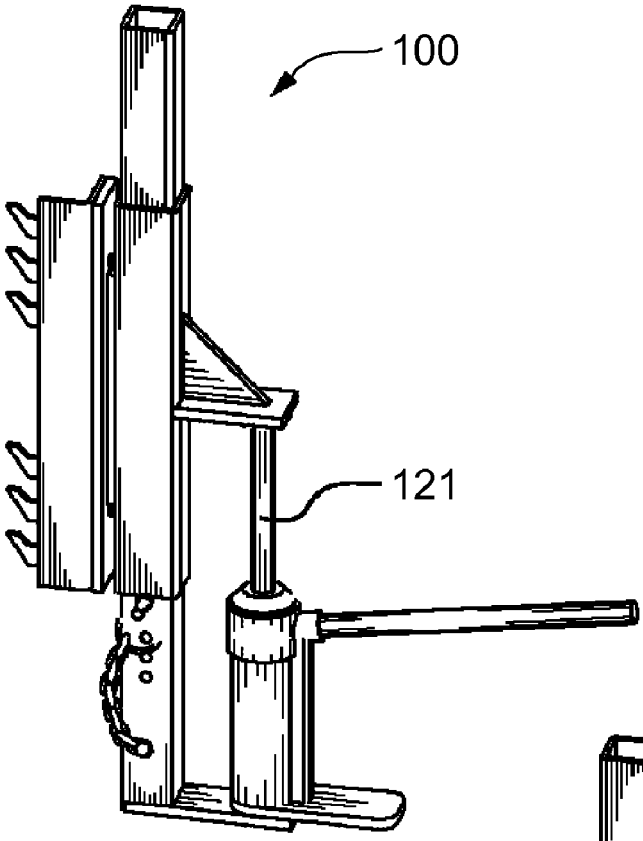
FIG. 4 is an elevation view of the engagement protuberance of FIG. 2 coupled to the partition lifter sub-assembly of FIG. 1.
Figure 5:
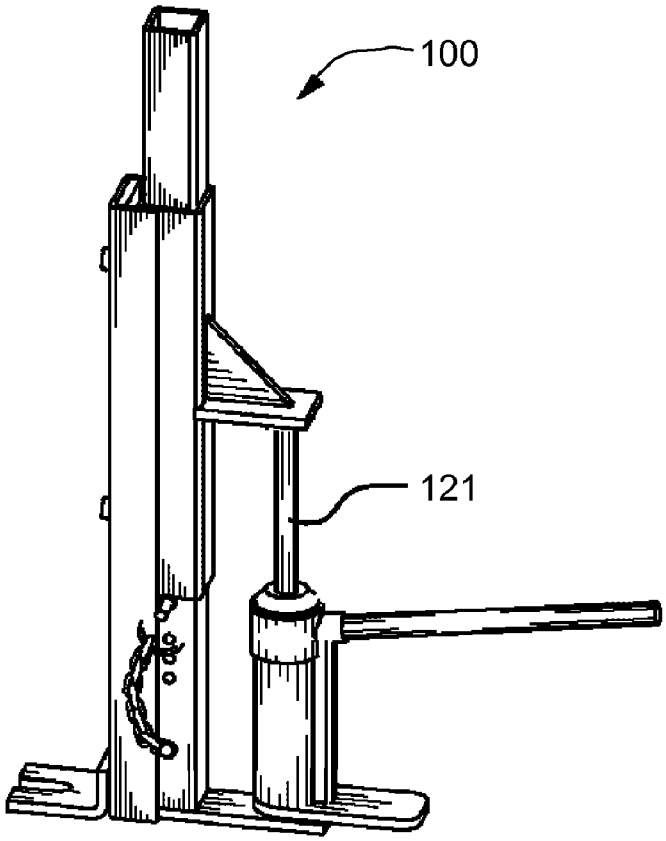
FIG. 5 is an elevation view of the engagement protuberance of FIGS. 3(*a*) and 3(*b*) coupled to the partition lifter sub-assembly of FIG. 1.

Referring to FIG. 1, there is shown, an example embodiment of a partition lifter sub-assembly 100 according to one embodiment of the present invention. A lifter sub-assembly shown generally at 10, comprises a vertical support beam 110, an extension actuator or jack 120 and a sleeve 130. The sub-assembly 100 may be combined with one or more engagement protuberances 200, 300. FIGS. 4 and 5 illustrate the assembled partition lifter where the illustrated engagement prouberances 200, 300 are coupled to sub-assembly 100.

The support beam 110 comprises a beam portion 111 and a base portion 112. The beam portion 111 extends substantially vertically upward from a floor surface (not shown) on which the base portion 112 sits to at least a height greater than a maximum height to which the wall partition (not shown) is to be elevated above the floor surface. A preferred height suitable for use with typical wall partition systems may be 16 inches. Preferably, the support beam is composed of tubular steel, such as 1 inch square tubular steel, or other rigid material capable of bearing a load of a plurality of wall partitions. For example, the beam portion 111 may be a wooden beam such as a 2×4. Preferably, the beam portion 111 is polygonal in shape, such as a square, to define a plurality of apexes so as to reduce the likelihood of the sleeve 130 twisting relative to the support beam 110.

The beam portion 111 has a plurality of bores 113 extending transversely through it, sized to accept a cotter pin 115 to prevent the sleeve 130 from falling below a desired extension position relative to the support beam 110. Preferably, the lowermost bore 113 is positioned about 4.5 inches away from the base and extends at a periodic interval, which may in one embodiment be every ¼ inch, along a substantial portion of the length of the beam portion 111.

In one embodiment, the cotter pin 115 is attached to the support beam 110, with a chain 116 or other attachment device at a position where the point of attachment will not interfere with the free movement of the sleeve 130 relative to the support beam 110 while in an operating position. Alternatively the cotter pin 115 may be attached to the sleeve 130 itself. One purpose of the cotter pin attachment is so that the cotter pin 115 is not misplaced during transportation of the sub-assembly 100. The load capacity of cotter pin 115 must be capable of bearing the weight of at least sleeve 130, engagement protuberances 200, 300 and the wall partition (not shown).

The base portion 112 abuts the beam portion 111 at one end thereof and extends slightly beyond the cross-section of the beam portion 111 at least in one direction so as to provide a lip that may be engaged by the jack 120. In one embodiment, the base portion 112 is 1 inch by 1.75 inches in dimension so as to provide a ¾ inch lip 114 onto which at least part of the jack 120 sits during operation. The base portion 112 also provides a measure of support so as to assist in maintaining the support beam 110 in a substantially vertical position. Preferably, the lip 114 extends along a side of the beam portion 111 through which none of the bores 113 pass.

The jack 120 is a controllable and reversible extension actuator. The jack 120 may be a portable hydraulic jack as shown in FIG. 1 or in the alternative, a ratcheting jack with a larger actuating handle. In one embodiment, the jack 120 is not attached to the sub-assembly 100, but may be removably positioned in an operating position so that its side is proximate to the support beam 110 and some or all of the jack 120 bears on some or all of the lip 114 of the base portion 112. The jack 120 is oriented such that a vertically extending ram 121 may extend and retract in a direction substantially transverse to the plane of the base 112 and away from the floor surface (not shown).

There is at least one benefit in the embodiment where the jack 120 is not permanently coupled to the lip 114 of the base portion 112. The removable nature of the jack 120 in conjunction with the capability of locking the sleeve 130 relative to the support beam 110 permits a single jack to be used in conjunction with a plurality of lifters and indeed other devices. This is beneficial as the jack 120 is often a more expensive and cumbersome component of the lifter sub-assembly 100.

In other embodiments, the jack 120 may be permanently coupled to the lip 114 of the base portion 112.

The sleeve 130 comprises a tubular portion 131, a jack-engaging ledge 132 and a spacer portion 133. The sleeve 130 is adapted to surround and slidingly engage the support beam 110. Preferably it is made of a similar but wider tubular material as the support portion 111, and shares the same polygonal cross-section, such as a square, so as to prevent twisting of the sleeve 130 relative to the support beam 110 while remaining freely slidable therealong.

The jack-engaging edge 132 is attached to, such as by welding, and extends transversely away from the tubular portion 131 along a side thereof through which the side bore 134 does not pass. When mounted on the support beam 110, the jack-engaging edge 132 is preferably positioned on the same side of the support beam 110 as the lip 114 of the base portion 112.

The spacer portion 133 is an elongate section attached to, such as by welding, the tubular portion 131 along a side thereof opposite to that to which the jack-engaging edge 132 is affixed. The spacer portion 133 acts to space the wall partition (not shown), when engaged by the lifter 100, away from the support beam 110 so as to reduce frictional contact between an extremity of the wall partition and the base 112 of the support beam 110, such as at the bottom.

Additionally, the spacer portion 133 provides two or more knobs 134 or other engagement device to facilitate attachment of the engagement protuberance 200, 300 thereto. The spacer portion 133 may comprise a planar portion abutting a truncated middle portion that is attached to the tubular portion 131 such as is shown in the embodiment of FIG. 1.

The engagement protuberance 200, 300 is a component that may be attached to the spacer portion 133 of the sleeve 130 such that it may engage a part of the wall partition in order to urge it upwards when the jack 120 is in position on top of the lip 114 of the base portion 112 and extending upward against the ledge 132.

Figure 2:
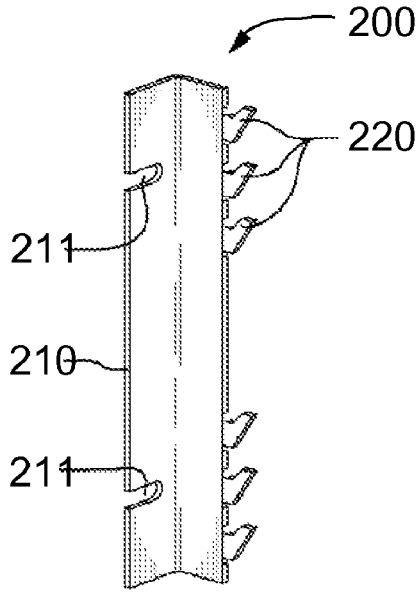
FIG. 2 is an elevation view of an engagement protuberance suitable for use with the partition lifter sub-assembly of FIG. 1, according to one embodiment of the present invention.
Figure 3A:
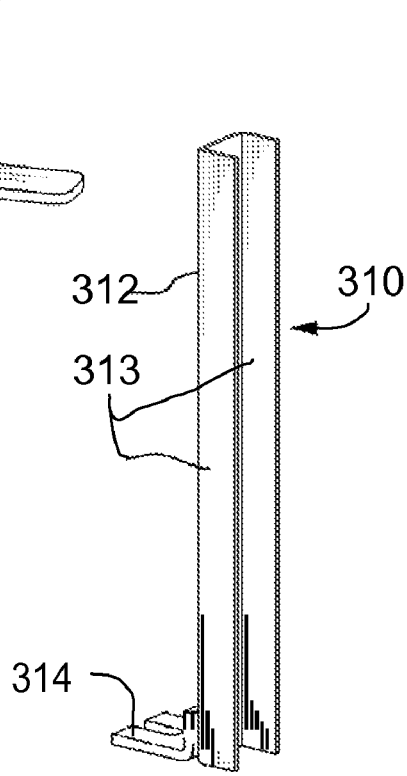
FIG. 3(*a*) is a side elevation view of an engagement protuberance suitable for use with the partition lifter sub-assembly of FIG. 1, according to another embodiment of the present invention.
Figure 3B:
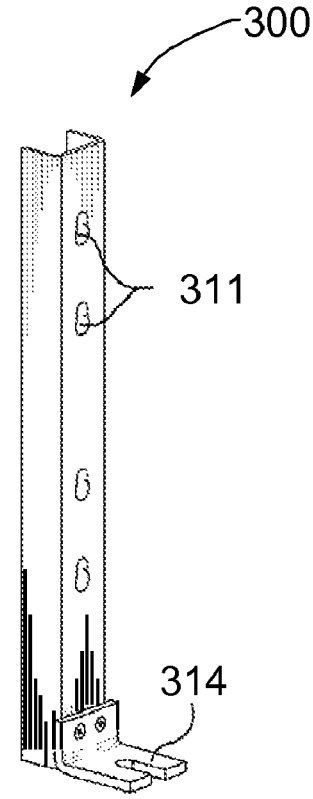

As shown in FIGS. 2 and 3, the engagement protuberance 200, 300 may have a variety of configurations, of which two are shown. The first configuration is shown in FIG. 2 and comprises an angle piece 210 with transverse slots 211 along one side to accommodate the knobs 134 of spacer portion 133 in a transverse sliding fit and a plurality of series of undercut hooks (six are shown in the Figure) along the other side for engagement with corresponding apertures of a hanging track of the wall partition (not shown).

The second configuration of engagement protuberance 300 is shown in FIGS. 3(*a*) and 3(*b*) and comprises a three-walled trough 310 adapted to fit around the sleeve 130, with a plurality of sets of at least two keyhole openings 311 in the middle wall 312 of the trough 310 for removeable locking engagement with the knobs 134. Side walls 313 are configured so as not to block bores 113 or otherwise interfere with the operation of cotter pin 115, as shown in FIG. 5. In FIG. 3(*b*), two sets of pairs of keyhole openings 311 are shown to provide a variety of positions of varying height. A foot plate 314 is adapted to be nudged under a ground-engaging end of the wall partition. Such foot plate 314 may extend outwardly about 2½ inches in one embodiment. Other engagement protuberance configurations may be suitable for removable attachment with spacer portion 133.

In another embodiment (not illustrated), the engagement protuberance 200, 300 is permanently coupled to the spacer portion 133. In yet another embodiment (not illustrated), the engagement protuberance 200, 300 and spacer portion 133 form one integral unit which is capable of being coupled to the sleeve 130.

As can be seen from a comparison of FIGS. 2 and 3, the different mechanisms employed by different embodiments of the engagement protuberance 200, 300 to engage the sub-assembly 100 are preferably interchangeable, namely in the size and design of the sleeve 130, especially the length of the tubular portion 131 owing to the different height of the sleeve 130 and the different point of engagement when the wall partition is engaged, and the shape and structure of the spacer portion 133. Other sleeve designs may also be suitable.

Optionally a plurality of engagement protuberances 200, 300 may be attached to the sleeve 130. Indeed, it is possible to have a plurality of sleeves 130 stacked one above the other on the support beam 110.

FIGS. 4 and 5 show the lifter 100 in both embodiments with the engagement protuberance 200 and 300 respectively, in position.

In operation, the lifter 100, if disassembled, may be assembled by sliding the sleeve 130 over the end of the support beam 110 that does not have the lip 114, with the ledge 132 on the same side of the support beam 110 as the lip 114 but on the far side of the sleeve 130 therefrom and if appropriate, attaching the engagement protuberance 200, 300 to the spacer portion 133 of the sleeve 130. The jack 120 is not yet placed into position.

The assembled lifter 100 (minus the jack 120) is then positioned against a wall partition (not shown) to be elevated and the engagement protuberance 200, 300 is engaged, by either gripping the slotted track extending vertically along each face of the wall partition (not shown) at its frame by the hooks 220 if protuberance 200 is used, or else gripping the bottom frame of the wall partition (not shown) by the footplate 314 if protuberance 300 is used.

The jack 120 is then positioned over at least part of the lip 114 in such a position that its extendable ram 121 engages the ledge 132. The jack 120 may be oriented such that the handle extends in the direction of the ledge 132 relative to the support beam 110 or in a direction transverse thereto, depending upon the particular operational configuration and in particular the available clearance around the wall partition (not shown).

The activation of the jack 120 causes its ram 121 to be vertically extended until the wall partition (not shown), at its point of engagement with the lifter 100 is elevated a given distance above the floor surface (not shown). This distance may range from a few inches to a few feet, depending on the clearance requirements of the task.

Once in position, the desired elevation of the wall partition (not shown) may be maintained by inserting the cotter pin 115 into one of the bores 113 in the support beam 110 below the lowest part of the sleeve 130 so as to prevent the sleeve 130 from sliding downwardly any further.

At this point, the jack 120 may be removed and/or replaced by a weight (not shown) positioned on the lip 114.

The weight of the wall partition, especially when elevated, and especially when the jack 120 has been removed and no weight has been substituted therefor above the lip 114, may typically cause the lifter 100 to topple over onto the wall partition. However typically during operation, the lifter 100 is being used to engage a wall partition that is interconnected with at least one wall partition extending transversely in the direction of the tendency to topple. The rigid attachment of these wall partitions serves to counteract the tendency to topple experienced by the wall partition being elevated, so that the wall partition being elevated may be at most tipped in the direction of the tendency to topple.

In many operational scenarios, such tipping of the wall partition is acceptable, for example, to prepare a floor surface and/or remove or add floor covering.

Nevertheless, if desired, the tipping can be alleviated after a short period by applying further lifters 100 at various opposing positions around the partition structure and elevating them to a similar height. This may be the case, for example, where the furniture within a cubicle is to be moved. By elevating the entire cubicle above the maximum height of the furniture, the furniture may be easily retrieved from below the elevated wall partitions and stored elsewhere without fear of banging the furniture against a wall partition and damaging either piece.

Once the use of the lifter 100 is completed, the lifter 100 may be disassembled into a small series of flat-lying and relatively compact components for storage or transport.

In the foregoing decription, for purposes of explanation and not limitation, specific details are set forth in order to provide a thorough understanding of the present invention. However, it will be apparent to those having ordinary skill in this art that the present invention may be practised in other embodiments that depart from these specific details.

In some instances, detailed descriptions of well-known devices and methods are omitted so as not to obscure the description of the present invention with unnecessary detail. All statements herein reciting principles, aspects and embodiments of the description, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those having ordinary skill in this art that block diagrams reproduced herein can represent conceptual views of illustrative components embodying the principles of the technology.

It will be apparent to those having ordinary skill in this art that various modifications and variations may be made to the embodiments disclosed herein, consistent with the present disclosure, without departing from the spirit and scope of the present disclosure.

For example, a side bore may be inserted into the tubular portion of the sleeve 130 to positively lock it into position against undesired further extension or contraction. Additionally, embodiments may be conceived where the sleeve 130 may be slid inside the beam portion 111 rather than outside it.

While preferred embodiments are disclosed, this is not intended to be limiting. Rather, the general principles set forth herein are considered to be merely illustrative of the scope of the present disclosure and it is to be further understood that numerous changes covering alternatives, modifications and equivalents may be made without straying from the scope of the present disclosure, as defined by the appended claims.

The term "couple" in any form is intended to mean either an direct or indirect connection through other devices and connections.

Moreover, all dimensions described herein are intended solely to be exemplary for purposes of illustrating certain embodiments and are not intended to limit the scope of the disclosure to any embodiments that may depart from such dimensions as may be specified.

Directional terms such as "upward", "downward", "left" and "right" are used to refer to directions in the drawings to which reference is made unless otherwise stated. Similarly, words such as "inward" and "outward" are used to refer to directions toward and away from, respectively, the geometric centre of a device, area and/or volume and/or designated parts thereof.

References in the singular form include the plural and vice versa, unless otherwise noted.

The terms "including" and "comprising" are used in an open-ended fashion, and thus should be interpreted to mean "including, but not limited to". The terms "example" and "exemplary" are used simply to identify instances for illustrative purposes and should not be interpreted as limiting the scope of the invention to the stated instances. In particular, the term "exemplary" should not be interpreted to denote or confer any laudatory, beneficial or other quality to the expression with which it is used, whether in terms of design, performance or otherwise.

Certain terms are used throughout to refer to particular components. As one skilled in the art will appreciate, manufacturers may refer to a component by different names. It is not intended to distinguish between components that differ in name but not in function.

Other embodiments consistent with the present application will become apparent from consideration of the specification and the practice of the disclosure disclosed herein.

What is claimed is:

1. A lifting apparatus for elevating a wall partition extending substantially transversely from a surface, comprising:

a. a support beam engaging and extending substantially transversely away from the surface;

b. a sleeve adapted to engage the support beam in a freely slidable fit and having a ledge extending transversely outwardly therefrom on a first side thereof;

c. an engagement protuberance extending transversely outwardly from a second side of the sleeve and adapted to engage and support the wall partition, d. an extension actuator having an extension end, the actuator adapted for positioning substantially on the surface such that the extension end engages the ledge for extending the sleeve and the partition transversely away from the surface; wherein said extension actuator is removable from said lifting apparatus; and e. a base mounted to the support beam at one end and protruding transversely away therefrom in a direction away from the engagement protuberance, the extension actuator for positioning thereon when the extension end engages the ledge.

2. A lifting apparatus according to claim 1, wherein the support beam is substantially tubular.

3. A lifting apparatus according to claim 1, wherein the support beam is substantially polygonal in cross-section.

4. A lifting apparatus according to claim 1, wherein the support beam has at least one transverse bore for accepting a transverse locking mechanism therewithin to inhibit movement of the sleeve toward the surface.

5. A lifting apparatus according to claim 4, wherein the transverse locking mechanism comprises a pin for insertion into one of the at least one transverse bores of the support beam.

6. A lifting apparatus according to claim 1, wherein the first side lies diametrically opposite the sleeve from the second side.

7. A lifting apparatus according to claim 1, wherein the sleeve is removable from the support beam.

8. A lifting apparatus according to claim 1, wherein the sleeve surrounds the support beam.

9. A lifting apparatus according to claim 1, wherein the sleeve comprises a spacer on the second side thereof, the spacer adapted to firmly engage the engagement protuberance.

10. A lifting apparatus according to claim 9, wherein the spacer comprises a plurality of outwardly extending knobs for attaching the engagement protuberance to the spacer.

11. A lifting apparatus according to claim 10, wherein the engagement protuberance is angle-shaped.

12. A lifting apparatus according to claim 11, wherein one side of the engagement protuberance comprises a plurality of transverse slots for removable engagement of the knobs of the spacer.

13. A lifting apparatus according to claim 10, wherein the engagement protuberance is trough-shaped and adapted to fit around the sleeve.

14. A lifting apparatus according to claim 13, where one side of the engagement protuberance comprises a plurality of keyhole slots for removable engagement of the knobs of the spacer.

15. A lifting apparatus according to claim 1, wherein the engagement protuberance is removable from the sleeve.

16. A lifting apparatus according to claim 1, wherein the engagement protuberance comprises at least one hook for engaging a mating slot on the wall partition.

17. A lifting apparatus according to claim 1, wherein the engagement protuberance comprises a foot plate for supporting a surface engaging portion of the partition.

18. A lifting apparatus according to claim 1, wherein the extension actuator is a jack.

19. A lifting apparatus according to claim 18, wherein the jack is hydraulically actuated.

20. A lifting system comprising a plurality of lifting apparatuses according to claim 1, adapted to be positioned at different wall partitions of a wall structure so as to elevate the wall structure beyond the surface.

21. A kit of parts for assembling a lifting apparatus for elevating a wall partition extending substantially transversely from a surface, the kit of parts comprising:

a. an elongate support beam having a protruding base;

b. a sleeve adapted to engage the support beam in a sliding fit and having a ledge extending transversely outwardly therefrom on a first side thereof;

c. an engagement protuberance extending transversely outwardly from a second side of the sleeve and adapted to engage and support the wall partition, d. an extension actuator having an extension end for engaging the base and the ledge for extending the sleeve and the partition transversely away from the base; wherein said extension actuator is removable from said lifting apparatus; and e. a base mounted to the support beam at one end and protruding transversely away therefrom in a direction away from the engagement protuberance, the extension actuator for positioning thereon when the extension end engages the ledge.

* * * * *